US009674904B2

(12) United States Patent
Radermacher et al.

(10) Patent No.: US 9,674,904 B2
(45) Date of Patent: Jun. 6, 2017

(54) SYSTEM AND METHOD FOR CONTROLLING DIMMING OF SOLID STATE LIGHTING DEVICE

(71) Applicant: PHILIPS LIGHTING HOLDING B.V., Eindhoven (NL)

(72) Inventors: Harald Josef Günther Radermacher, Aachen (DE); Patrick Alouisius Martina De Bruycker, Nuenen (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/350,443

(22) PCT Filed: Oct. 12, 2012

(86) PCT No.: PCT/IB2012/055541

§ 371 (c)(1),
(2) Date: Apr. 8, 2014

(87) PCT Pub. No.: WO2013/054297

PCT Pub. Date: Apr. 18, 2013

(65) Prior Publication Data

US 2014/0252992 A1 Sep. 11, 2014

Related U.S. Application Data

(60) Provisional application No. 61/645,780, filed on May 11, 2012, provisional application No. 61/547,082, filed on Oct. 14, 2011.

(51) Int. Cl.
*H05B 33/08* (2006.01)

(52) U.S. Cl.
CPC ..... *H05B 33/08* (2013.01); *H05B 33/0815* (2013.01); *H05B 33/0851* (2013.01)

(58) Field of Classification Search
CPC H05B 33/0815; H05B 37/02; H05B 37/0254; H05B 37/029; H05B 33/0818;
(Continued)

(56) References Cited

U.S. PATENT DOCUMENTS 4,144,478 A 3/1979 Nuver
6,016,038 A 1/2000 Mueller et al.
(Continued)

FOREIGN PATENT DOCUMENTS

GB 2478284 A 9/2011
JP 2007035403 A 2/2007
(Continued)

*Primary Examiner* — Crystal L Hammond

(57) ABSTRACT

Determining an amount of light output from a solid state lighting (SSL) unit based on a dimmer setting includes determining the dimmer setting of the dimmer during a readout mode by analyzing a power signal received from the dimmer, the dimmer setting indicating a desired level of light, determining power needed at input terminals of the SSL unit for an SSL load to output the desired level of output light, and determining a value of an adjusting signal for adjusting the power at the input terminals of the SSL unit during a power reception mode, based at least in part on the determined dimmer setting, causing the SSL unit to output the desired level of light.

19 Claims, 8 Drawing Sheets

(58) Field of Classification Search
CPC ..... H05B 33/0845; H05B 33/0848; H05B 39/083; H05B 33/08; H05B 33/0851; H05B 33/0896; H05B 33/0812; Y02B 20/346; Y02B 20/383
See application file for complete search history.

(56) References Cited

U.S. PATENT DOCUMENTS 6,211,626 B1 4/2001 Lys et al.
6,211,627 B1 * 4/2001 Callahan ..... 315/294
7,852,017 B1 * 12/2010 Melanson ..... H05B 33/0815 315/185 S
8,111,017 B2 * 2/2012 Lin ..... H05B 37/0263 315/209 R
8,536,794 B2 * 9/2013 Melanson ..... H05B 33/0809 315/291
2004/0212324 A1 * 10/2004 Callahan ..... 315/312
2006/0255959 A1 * 11/2006 Salvestrini ..... H05B 39/08 340/664
2007/0182338 A1 * 8/2007 Shteynberg et al. ..... 315/200 R
2008/0203936 A1 * 8/2008 Mariyama ..... H05B 33/0815 315/246
2009/0108765 A1 * 4/2009 Weightman ..... H05B 39/08 315/224
2009/0243582 A1 * 10/2009 Irissou ..... H05B 39/08 323/320
2009/0261744 A1 10/2009 Chen et al.
2010/0013409 A1 * 1/2010 Quek ..... H05B 33/0815 315/294
2010/0213859 A1 8/2010 Shteynberg et al.
2011/0012530 A1 * 1/2011 Zheng ..... H05B 33/0815 315/294
2011/0156610 A1 * 6/2011 Ostrovsky et al. ..... 315/291
2011/0175543 A1 * 7/2011 Sun ..... H05B 33/0818 315/291
2011/0266974 A1 * 11/2011 Thornton ..... H05B 33/0851 315/297
2011/0285303 A1 * 11/2011 Deurenberg ..... H05B 41/3924 315/209 R
2012/0019714 A1 * 1/2012 Hiramatu ..... H05B 33/0815 348/370
2012/0086354 A1 * 4/2012 Daniel ..... H05B 39/08 315/287
2012/0146539 A1 * 6/2012 Riesebosch ..... H05B 33/089 315/291
2012/0161665 A1 * 6/2012 Thornton ..... H05B 33/0854 315/291
2012/0181944 A1 * 7/2012 Jacobs et al. ..... 315/224
2012/0268030 A1 * 10/2012 Riesebosch ..... 315/276
2012/0286686 A1 * 11/2012 Watanabe ..... H05B 33/0815 315/224
2013/0049631 A1 * 2/2013 Riesebosch ..... H05B 33/0845 315/291

FOREIGN PATENT DOCUMENTS

JP 2011113711 A 6/2011
WO 2010146529 A1 12/2010
WO 2011045371 A1 4/2011
WO 2011100803 A1 8/2011

* cited by examiner

SYSTEM AND METHOD FOR CONTROLLING DIMMING OF SOLID STATE LIGHTING DEVICE

TECHNICAL FIELD

The present invention is directed generally to control of solid state lighting devices. More particularly, various inventive methods and apparatus disclosed herein relate to controlling dimming of a solid state lighting module.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g., red, green, and blue, as well as a processor for independently controlling the output of the LEDs in order to generate a variety of colors and color-changing lighting effects, for example, as discussed in detail in U.S. Pat. Nos. 6,016,038 and 6,211,626, which are hereby incorporated by reference.

There is a need for dimmable solid state lighting (SSL) units, such as retrofit SSL lamps, including LED lamps. The SSL lamps should be compatible with a wide range of existing dimmers. However, most existing dimmers have been designed for operation with incandescent light lamps. SSL lamp input characteristics typically differ from incandescent light bulbs, so interfacing circuitry is required for correct operation.

Many techniques have been proposed for configuring SSL lamps to enable "normal" dimmer operation. In other words, the techniques seek to emulate incandescent lamp behavior, e.g., by providing a low impedance current path during zero crossing. This allows auxiliary dimmer supply and dimmer timing circuit operation similar to the traditional load. However, control information regarding dimming ("dim information") is received by the SSL lamp via a phase cut power signal, so control information and energy are incorporated in the same signal. Accordingly, the power signal must be separated into the control information part and the power part. Compromises in efficiency of reception and processing of the power signal (e.g., the above-mentioned low impedance path, often realized by lossy bleeders) are required to obtain stable and continuously available dim information.

Low cost dimmers are often based on simple resistor-capacitor (RC) timing circuits, where a variable resistor (potentiometer) charges a fixed capacitor. When the capacitor voltage reaches a threshold value, a power switch is activated or deactivated. The duration during which the power switch stays on is determined by the type of power switch, the load and/or other timing circuits. "Emulation" of an incandescent light bulb attempts to provide "normal" operation of the RC timing circuit. As mentioned above, the dimmer will provide a phase cut power signal to the lamp, containing both energy and dim information. Thus, the power signal delivered to the lamp may change from one (half-) cycle to the next, preventing continuous, stable operation of the timing circuit. Also, the desired level of light to be output by the SSL lamp as indicated by the conventional dimmer setting may not be properly translated to the SSL lamp, resulting in a level of output light that differs from the expected desired level of output light.

Thus, there is a need in the art for an SSL unit capable of providing continuous, stable operation during dimming operations, and of outputting a level of light consistent with the dimmer setting.

SUMMARY

The present disclosure is directed to inventive apparatus and method for controlling light output by a solid state lighting (SSL) unit connected to a dimmer, including determining a dimmer setting of the dimmer during a readout mode by analyzing a power signal from the dimmer, and adjusting power at input terminals of the SSL unit during a power reception mode based at least in part on the determined dimmer setting to cause the SSL unit to output a desired level of light.

Generally, in one aspect, a method is provided for determining an amount of light output from a solid state lighting (SSL) unit based on a dimmer setting. The method includes determining the dimmer setting during a readout mode by analyzing a power signal received from the dimmer, the dimmer setting indicating a desired level of light; determining power needed at input terminals of the SSL unit for an SSL load to output the desired level of output light; and determining a value of an adjusting signal for adjusting the power at the input terminals of the SSL unit during a power reception mode, based at least in part on the determined dimmer setting, causing the SSL unit to output the desired level of light.

In another aspect, a method is provided for controlling light output by an SSL unit connected to a dimmer. The method includes receiving a power signal from the dimmer; determining the dimmer setting based on the power signal; determining a desired level of output light from the SSL unit corresponding to the determined dimmer setting; determining a desired input voltage at an input terminal of the SSL unit that would cause the SSL unit to output the desired level of output light; and determining a value of an adjusting signal needed to adjust an input voltage at the input terminal to equal the determined desired input voltage.

In yet another aspect, an SSL unit is configured to connect to a dimmer in a dimmer circuit, the SSL unit including a light emitting diode (LED) module, at least one input terminal, a processing circuit, a signal generating module, and a power reception module. The input terminal is configured to receive input power from the dimmer, the input power corresponding to a dimmer voltage across the dimmer. The processing circuit is configured to determine a dimmer setting of the dimmer during a readout mode by analyzing the input power, the dimmer setting indicating a desired level of output light from the LED module. The signal generating module is configured to generate an adjusting signal based at least in part on the determined dimmer setting. The power reception module is configured to adjust the input power at the at least one input terminal during a power reception mode using the adjusting signal to cause the LED module to output the desired level of light.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus, such as an SSL or LED lamp, including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Applicants have recognized and appreciated that it would be beneficial to provide a circuit capable of adjusting light output by a solid state lighting (SSL) unit to more accurately reflect actual dimmer setting, particularly in dimmer circuits designed for conventional or incandescent light sources.

Thus, according to various embodiments, dim information is captured, e.g., from a typical two-wire dimmer, by an SSL unit, such as an SSL lamp (e.g., LED lamp) retrofit for inclusion in conventional dimmer circuits. The SSL unit may include one or more LED light sources, for example. In various embodiments, the SSL unit detects the setting of the dimmer (e.g., a set resistor or potentiometer setting) based on the input voltage received at its input terminals, and generates an adjusting signal to adjust the input voltage at its input terminals based on the detected dimmer setting. The adjusted input voltage causes the SSL unit to output light that more accurately reflects the desired light output indicated by the detected dimmer setting. In other embodiments, the SSL unit detects the dimmer setting, and influences the dimmer voltage output by the dimmer based on the detected dimmer setting. For example, the SSL unit may manipulate a firing angle of the dimmer TRIAC in order to induce firing at a different time (earlier or later) to produce a desired dimmer voltage. Consequently, the normally fixed (e.g., tailored to incandescent bulbs) relation between the dimmer setting and the voltage provided to the SSL unit is influenced by the SSL unit itself.

An SSL unit including a power converter, or a reconfigurable LED string or matrix has some ability to control the amount of power consumed from a given input voltage signal, for example. This functionality contrasts with the passive properties of an incandescent light bulb. The various embodiments described herein add presenting voltages to the input terminals of the SSL unit, enabling first and second modes of operation, discussed below.

Figure 1:
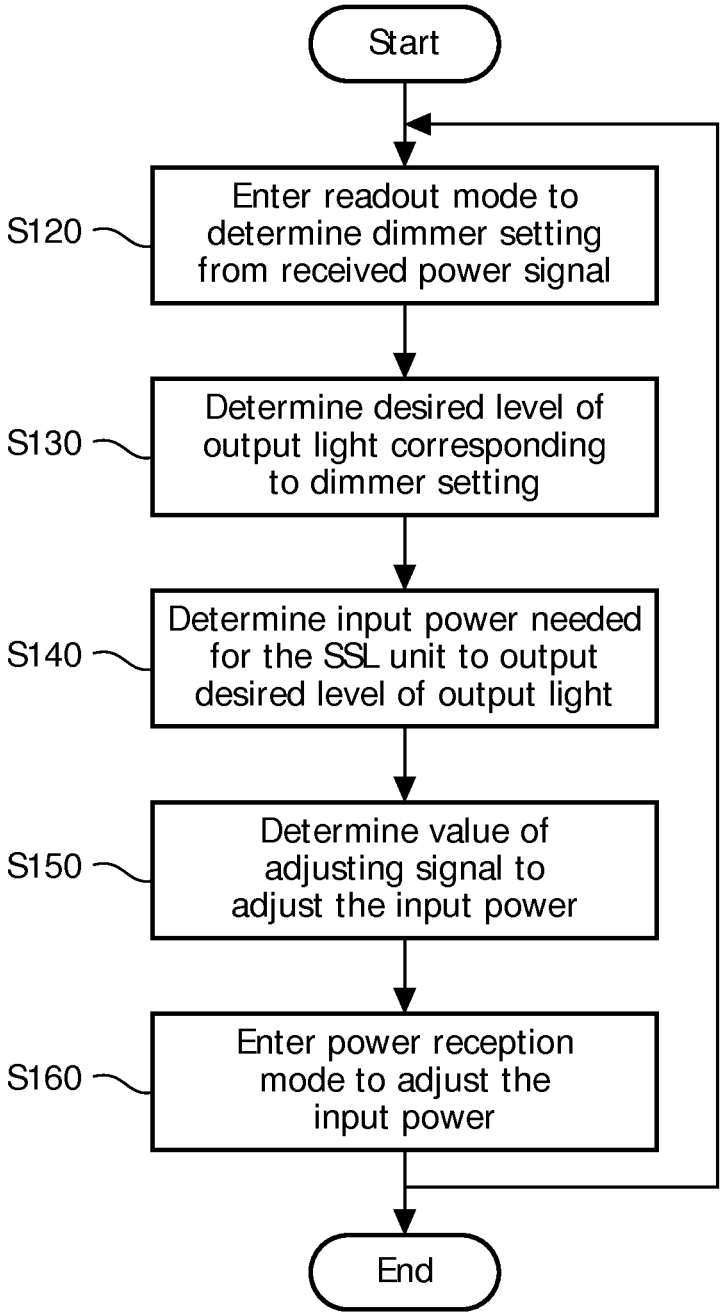
FIG. 1 is a flow diagram showing a process of controlling voltage received by a solid state lighting unit, according to a representative embodiment.

For example, FIG. 1 is a flow diagram showing a method of controlling dimming of an SSL unit, according to a representative embodiment.

Generally, the SSL unit (e.g., LED lamp) functions in first and second modes of operation during a power adjustment cycle, respectively referred to as a readout mode (detection cycle) and a power reception mode (power intake cycle). At start-up, the SSL unit initially receives power, and enters the readout mode in block S120, in which the SSL unit reads out or otherwise determines the dimmer setting of the dimmer from a received power signal, such as a phase cut power signal. For example, the dimmer setting may be determined by calculating the resistance of a set resistor or potentiometer in the dimmer used to set the dimming level, as discussed below. The resistance may be calculated, for example, by measuring a curve of the waveform of dimmer voltage Vdim, as discussed below with reference to FIGS. 5-7. That is, determining the dimmer setting may include bringing the dimmer into a non-conducting state with known initial conditions, and measuring a slope of the dimmer voltage Vdim based measuring input voltage Vin at input terminals of the SSL unit and estimating mains voltage Vm, as shown in FIG. 6. Alternatively, determining the dimmer setting may include measuring a time until firing of a dimmer switch or TRIAC (discussed below) in the dimmer based on measuring the input voltage Vin and estimating the mains voltage Vm, and deriving the dimmer setting from the measured time, as shown in FIG. 7. The dimmer setting indicates the level of output light (relative to the nominal output of the SSL unit) desired by the user. However, in the absence of the disclosed embodiments, this level of output light may not be accurately translated to the level of light actually output by the SLL unit, e.g., due to incapability between the dimmer and the SSL unit, as discussed above.

The SSL unit performs calculations in blocks S130-S150 to adjust the amount of received power. The SSL unit receives and processes the power, provided by the same received power signal, in order to cause the SSL unit to output the desired level of output light in the power reception mode of block S160, as indicated by the dimmer setting determined in block S120. In other words, the amount of power for driving the SSL load (e.g., an LED string) is determined based, in part, on the previously determined dimmer setting. More particularly, in block S130, the SSL unit determines the desired level of output light corresponding to the dimmer setting based on the dimmer setting. For example, the SSL unit may include a look-up table that correlates dimmer settings of the dimmer with predetermined output light levels.

The SSL unit is then able to determine a desired input power in block S140, which would achieve the desired level of output light when applied to input terminals of the SSL unit. Determination of the desired input power may factor in internal information, such as temperature or age (operating hours) of the lamp. In block S150, SSL unit determines the value of an adjusting signal needed to adjust the actual input power to achieve the desired input power, where the SSL unit generates the adjusting signal, accordingly. In block S160, the SSL unit enters the power reception mode to adjust the input power using the adjusting signal determined in block S150, thereby powering the SSL unit to provide output light at the desired level. The SSL unit also generates a drive current for driving the SSL load in response to the adjusted amount of power.

In an embodiment, the adjusting signal may be an internal command for adjusting a drive current to the SSL load of the SSL unit, for example, by adjusting a setpoint of the SSL. In another embodiment, the adjusting signal may be one of a voltage signal, a current signal or an impedance generated by the SSL unit in order to alter or manipulate the input voltage Vin at the input terminals of the SSL unit. For example, the amount of power for driving the SSL load may be adjusted by altering the dimmer voltage Vdim across the dimmer itself, which in turn adjusts the input voltage Vin. The input voltage Vin is used to determine and generate a drive voltage for driving the SSL load.

The process periodically loops back to the readout mode in block S120, in accordance with the predetermined schedule or power adjustment cycle, in order to update the determined dimmer setting and/or the corresponding amount of power, as indicated by the arrow returning to block S120. Accordingly, the SSL unit is able to adjust for changes in the dimmer setting and/or the dimmer's reaction to the SSL unit's previous adjustment within an acceptable time period. For direct interaction with a user, short reaction times of less than one second (e.g., on the order of about 100 ms) are desirable. For example, based on a 50 Hz system, there may be two half cycles used for determining the dimmer setting during the readout mode in block S120, followed by ten half cycles of power reception in the power reception mode in block S160 based on the determined dimmer setting. When the most recent dimmer setting differs significantly from the previously read dimmer setting and/or significant changes were noticed during the previous power reception mode, the transition may include multiple cycles in the readout mode, and/or a transfer function may be implement to provide a smoother response of the light output.

Although not shown in FIG. 1, the determination of the amount of power may consider other factors as well, such as feedback from the SSL load, so that further adjustments may be made to match the desired level of light. For example, the feedback may indicate an actual setpoint of the SSL load, where the actual setpoint is compared with a desired setpoint corresponding to the desired level of light, and a setpoint command is adjusted in response to the comparison to adjust the actual setpoint accordingly. The power adjustment cycle may be tied to the cycle of the AC mains voltage signal, such that the readout mode occurs during a first predetermined number of half cycles followed by the power reception mode occurring during a second predetermined number of half cycles, as discussed below.

The processes of the readout mode in block S120 and the power reception mode in blocks S130-S150 are performed under control of a processing circuit in the SSL unit, such as processing circuit 240, 340. The processing circuit may also handle all other activities in the SSL unit, such driver control, feedback, standby mode, remote control signal processing, temperature protection, and the like. In various embodiments, the processing circuit may be implemented as a controller or microcontroller, for example, including a processor or central processing unit (CPU), ASICs, FPGAs, or combinations thereof, using software, firmware, hard-wired logic circuits, or combinations thereof. When using a processor or CPU, a memory is included for storing executable software/firmware and/or executable code that controls operations of the processing circuit. The memory may be any number, type and combination of nonvolatile read only memory (ROM) and volatile random access memory (RAM), and may store various types of information, such as computer programs and software algorithms executable by the processor or CPU. The memory may include any number, type and combination of tangible computer readable storage media, such as a disk drive, an electrically programmable read-only memory (EPROM), an electrically erasable and programmable read only memory (EEPROM), a CD, a DVD, a universal serial bus (USB) drive, and the like.

Figure 2:
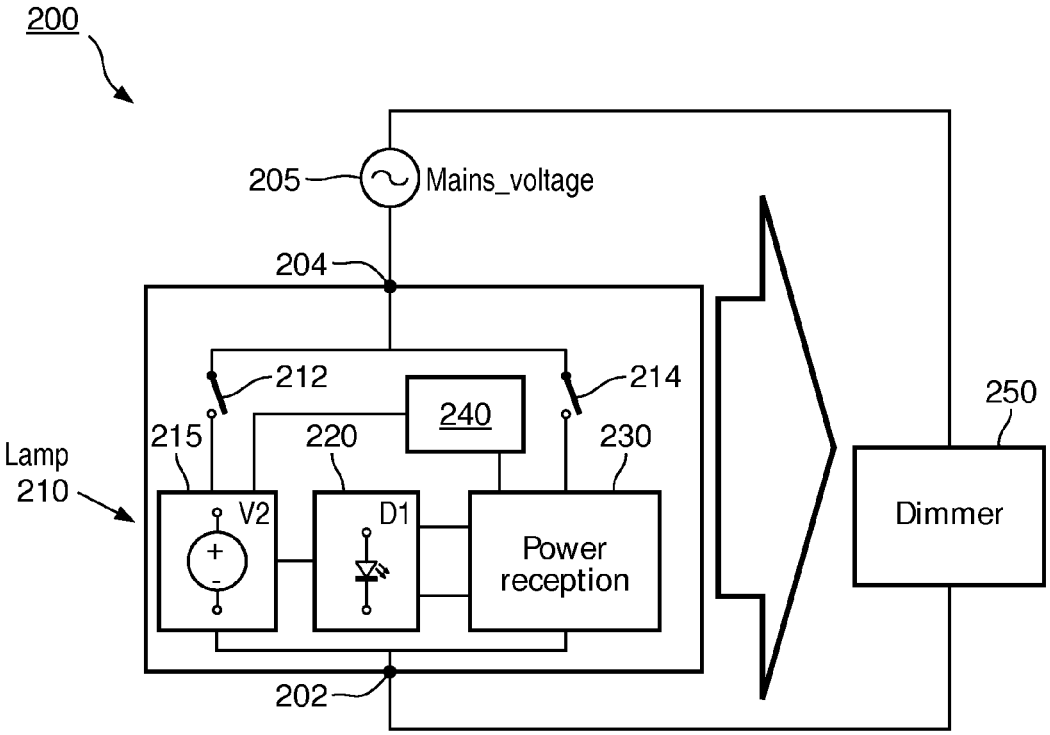
FIG. 2 is a simplified block diagram showing a dimmer circuit including a solid state lighting unit, according to a representative embodiment.
Figure 3:
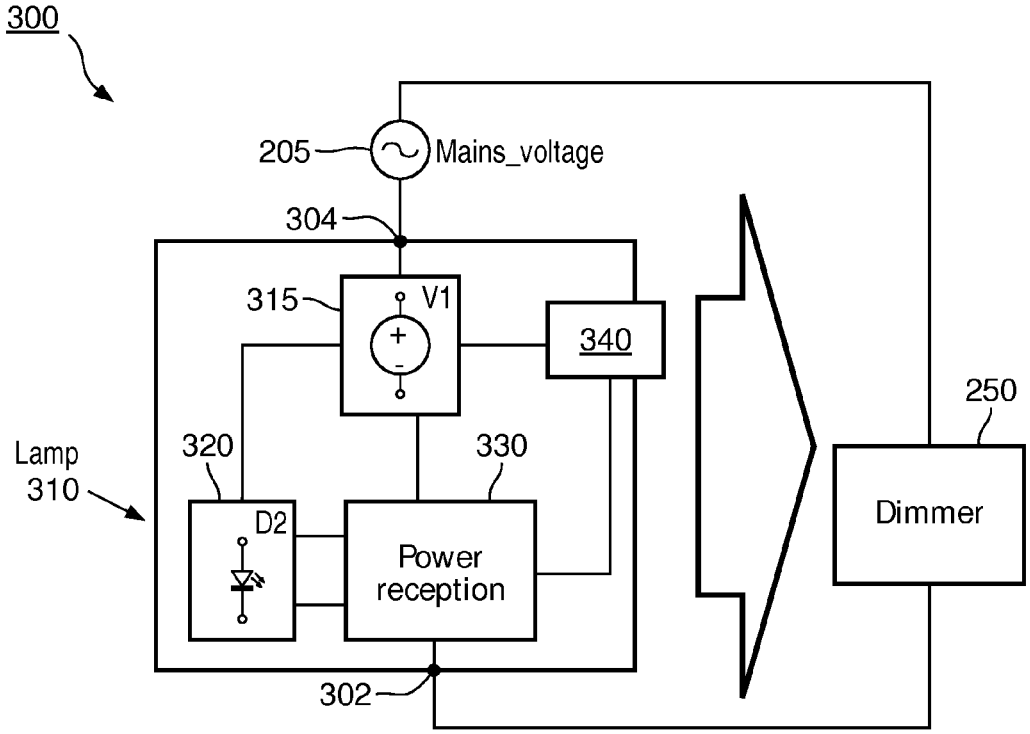
FIG. 3 is a simplified block diagram showing a dimmer circuit including a solid state lighting unit, according to a representative embodiment.

To support the operation of FIG. 1, the SSL unit includes means to impress a signal at its input terminals, as well as a power reception module. FIGS. 2 and 3 are simplified block diagrams showing SSL units, according to representative embodiments, which include structures for impressing a signal with a normal power input stage.

Referring to FIG. 2, dimmable lighting system 200 includes SSL unit 210 connected to dimmer 250, which receives and dims the mains voltage from mains voltage source 205. The dimmer 250 may be a conventional dimmer configured for dimming incandescent bulbs, for example, operable by adjusting a potentiometer (e.g., set resistor 420 discussed below with reference to FIG. 4).

The SSL unit 210 includes signal generating module 215, LED module 220 and power reception module 230, all of which are under the control of processing circuit 240. The signal generating module 215 is representative of means for impressing a signal at input 202 (e.g., input terminals), and the power reception module 230 is representative of the power input stage, such that the means for impressing a signal and the power input stage are connected in parallel between input 202 and output 204. The signal generating module 215 is shown as a voltage source in the depicted example, although it is understood that the SSL unit 210 may be configured to include a current source or impedance as the signal generating module 215 in place of a voltage source, without departing from the scope of the present teachings. The signal generating module 215 applies the voltage (or current or impedance) to enable reading out the dimmer setting.

The signal generating module 215 and the power module 230 may be selectively connected between the input 202 and the output 204 via switches 212 and 214, which exemplify perfect decoupling between generating module 215 and the power module 230. Alternatively, one or both of the signal generator module 215 and the power module 230 may be permanently connected to the input 202 (i.e., no switches 212 and 214), but their operations are controlled, e.g., using internal enabling and disabling capabilities, such that the respective operations are performed without distortion from the other module, or at least such that errors occurring due to the presence of the other module can be tolerated or compensated for. In an embodiment, the signal generating module 215 and the power reception module 230 are controlled by the processing circuit 240 to perform the processes of the readout mode and the power reception mode, discussed with reference to FIG. 1, in order to adjust the input voltage Vin at the input 202 to attain the desired light output by the LED module 220 based on the determined dimming level. The switches 212 and 214 are likewise controlled by the processing circuit 240 in order to selectively connect the means for impressing the signal and the power input stage, respectively.

Referring to FIG. 3, dimmable lighting system 300 similarly includes SSL unit 310 connected to dimmer 250, which receives and dims mains voltage from mains voltage source 205, under control of processing circuit 340. The SSL unit 310 includes signal generator 315, LED module 320 and power reception module 330. The signal generator 315 is representative of means for impressing a signal at input 302, and the power reception module 330 is representative of the power input stage, such that the means for impressing a signal and the power input stage are in series between input 302 and output 304. The signal generator 315 is shown as a voltage source in the depicted example, although it is understood that the SSL unit 310 may be configured to include a current source or impedance in place of the voltage source as the signal generator 315, without departing from the scope of the present teachings. The signal generating module 315 applies the voltage (or current or impedance) to enable reading out the dimmer setting. The signal generating module 315 and the power reception module 330 are controlled by the processing circuit 340 to perform the processes of the readout mode and the power reception mode, discussed with reference to FIG. 1, in order to adjust the input voltage Vin at the input 302 to attain the desired light output by the LED module 320 based on the determined dimming level.

Notably, the separation of the means for impressing a signal and the power input stage in FIGS. 2 and 3 is intended only to show the functional structure. In a realization, both functionalities may share components. For example, the one or more of the signal generator 215, 315, the power reception module 230, 330 and the processing circuit 240, 340 may be included in a power factor control (PFC) circuit. When the signal generator 215, 315 is in the PFC circuit, then only means for presenting the signal (e.g. voltage) to the input 202, 302 are required. In any case, there will be additional means for control and measurement (not shown) For example, there may be a switch mode power supply unit for converting received power to the required voltage or current signal for the LED module 220, 320. The power supply unit may have a control input for setting the amplitude of the voltage or current signal to the LED module 220, 320 (for ultimately influencing the amount of output light). This control input may be connected to an output of the processing circuit 240, 340, where a signal in response to the detected dimmer setting and determined output light is present.

The power delivered to the LED module 220, 320 should be smooth to avoid flickering or stroboscopic effect of the light output. Accordingly, the SSL unit 210, 310 may include means for energy storage, such as a capacitor (not shown) that can supply the LED module 220, 320 during the time interval of the readout mode, in case power transfer to the SSL unit 210, 310 is limited during this time interval. In order to minimize the required amount of stored energy, the readout mode may be split into shorter periods, e.g., one half cycle, as discussed above. In an embodiment, shorter readout mode periods may be possible, depending on the dimmer setting, by switching to the power reception mode immediately after the dimmer setting has been read in the readout mode, even within the one half cycle. Generally, the overall power scheme and the power intake should by symmetrical to provide the same amount of positive and negative half cycles for each of the readout and power reception modes. For example, the readout may be performed during half cycle #1, which may be positive, and the power intake may be performed during half cycles #2-7. Next, half cycle #8, which is negative, may be used for readout.

When multiple SSL units are operated on a single dimmer (connected to the same supply wires), each SSL unit individually follows the same control rules and uses the same cycle for readout and power intake. Otherwise, the readout mode of one SSL unit may be distorted by the relatively low impedance of the other SSL units during their respective power reception modes. In an embodiment, when there are multiple SSL units, they may be organized into a master-slave arrangement, in which there is a small, arbitrary or factory set timing difference between readout modes of the SSL units. For example, in a typical arbitration scheme, a first SSL unit, which is still in a wait mode and "planning" to start a readout mode, may notice that a second SSL unit has just started its a readout mode because a certain signal or pattern is present on its input terminals. Then, the first SSL unit will perform a passive readout, e.g., by simply monitoring the signals on its input terminals without actively providing any signals (voltages, currents, low impedances, etc.) to the common supply wires. Next to the second SSL unit, there may be a third SSL unit (as well as additional SSL units) listening. The master-slave arrangement may settle into a fixed arrangement, but is also possible that in a next readout mode, the first SSL unit may be the active lamp, while the second SSL unit and the third SSL unit are listening. Notably, when an SSL unit is operated with one or more incandescent bulbs on an existing dimmer, the incandescent bulb will likely guarantee the correct dimmer operation, such that the SSL units can simply monitor the dimmer setting.

For purposes of further explanation, it is assumed that the dimmer (e.g., dimmer 250) is a trailing edge dimmer with a TRIAC power switch (TRIAC dimmer). Alternatively, the dimmer may be a trailing edge dimmer with a metal-oxide semiconductor field-effect transistor (MOSFET) (MOSFET dimmer), and may include control circuit emulation of a TRIAC. In a TRIAC dimmer, the TRIAC is turned on in response to a firing signal and turned off when current flow falls below a holding current. However, the various embodiments disclosed herein may be implemented using other types of dimmers, without departing from the scope of the present teachings. The dimmers may be referred to as phase-cut dimmers, for example.

Figure 4:
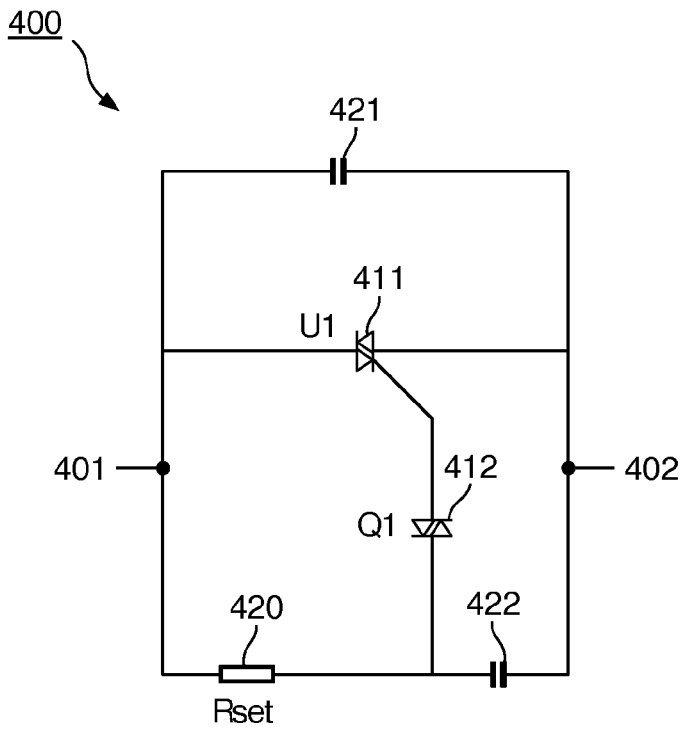
FIG. 4 is a simplified circuit diagram showing a dimmer used for dimming a state lighting unit, according to a representative embodiment.

FIG. 4 is a simplified circuit diagram showing the internal structure of representative two-wire dimmer 400. The dimmer 400 includes set resistor 420, first and second capacitors 421 and 422, and first and second switches. The first switch is a power switch or other threshold device, and is referred to herein as TRIAC 411, for example. The second switch is a timing switch or other trigger device, and is referred to herein as a DIAC 412, for example. In an embodiment, the first and second switches and may be included in the same package, and referred to as a Quadrac (which is effectively an internally triggered TRIAC). Functionality of the first and second switches may be implemented using MOSFET transistors, and additional control electronics, e.g., for emulating the behavior of TRIAC and DIAC, respectively. Another type of switch may be used without departing from the scope of the present teachings. The set resistor 420 and the second capacitor 422 (Ctime) form a timing circuit for triggering or "firing" the TRIAC 411. That is, the DIAC 412 triggers the TRIAC 411 to fire (at the firing angle) when a threshold value of the DIAC 412 is reached. The first capacitor 421 (Csnub) protects the TRIAC 411. When the TRIAC 411 is activated (closed) and conducting, the dimmer voltage Vdim across dimmer terminals 401 and 402 is nearly zero. When the TRIAC 411 is deactivated (open) and not conducting, the momentary level of the mains voltage (e.g., mains voltage Vm from mains voltage source 205) is divided across the dimmer 400 and the impedance of the load (e.g., SSL unit 200 or 300).

Due to the first capacitor 421 across the TRIAC 411, the timing circuit is able to function to some extent even without a load current. That is, the first and second capacitors 421 and 422 may charge or discharge one another until their corresponding voltages are equal, or until the threshold value of the DIAC 412 is reached, triggering the TRIAC 411, which then shunts the terminals 401 and 402, at least for some period in time. Therefore, when starting from a know dimmer voltage Vdim across the dimmer 400 and a know state of charge in the second capacitor 422, the time until the first switch 411 is activated or the rate of change in the dimmer voltage Vdim provides information regarding the value of the set resistor 420. In the depicted configuration, the set resistor 420 may have a range of values from about 10kΩ to about 500kΩ, the first capacitor 421 may have a value of about 100 nf, and the second capacitor 422 may have a value of about 47 nf, for example, where the values effectively provide a scaling factor. Of course, the implementation and values of the various components may vary to provide unique benefits for any particular situation or to meet application specific design requirements of various implementations, as would be apparent to one skilled in the art.

According to various embodiments, this circuit behavior of the dimmer 400 is used to gain knowledge of the value of the dimmer setting (e.g., value of the set resistor 420), which in turn is used to set the SSL unit into a desired state. That is, instead of operating the SSL unit with the actual phase cut power signal provided by the dimmer 400, where the SSL unit receives the dim information while simultaneously consuming power from the same phase cut power signal, the SSL unit enters the readout mode to initially determine the dimmer setting using the dim information gleaned from in the phase cut power signal. As discussed above, during the readout mode, the SSL unit provides signals (e.g., voltages, currents or impedances) to the input terminals (e.g., input 202) that enable the dimmer 400 to operate in an unusual, but well controlled mode, enabling determination (or approximation) of the dimmer setting by the SSL unit. As mentioned above, the dimmer setting indicates the level of light desired by the user, although this level of light may not be accurately translated to the light actually output by the LED module (e.g., LED module 220), due to incapability between the dimmer 400 and the SSL unit, in the absence of the embodiments discussed herein.

Once the dimmer setting is determined, the SSL unit then enters the power reception mode, as discussed above. During the power reception mode, the SSL unit may adjust the drive current to the LED module, e.g., via a power converter, so that the SSL load outputs the desired level of output light. Alternatively, as discussed above, the SSL unit may shift the phase angle to values that are more suitable for efficiently powering the LED module at the desired level. Certain types of SSL unit, such as LED lamps or driver electronics, work most efficiently with a predetermined relationship between peak input voltage and power, which relationship may differ from the relationship generated by the dimmer 400, which is tailored for incandescent bulbs. For example, by "boosting" the voltage across the dimmer terminals 401 and 402, as long as the TRIAC 411 is not active, the second capacitor 422 is charged more quickly and thus the TRIAC 411 will fire earlier. At low dimmer settings, which normally result in very late firing of the dimmer 400, this manipulation leads to higher peak voltages, which are better suited for operation of a given (selected) number of LEDs connected in series within the LED module. As another example, the SSL unit may try to reduce the peak voltage in order to increase efficiency of a (linear) auxiliary power supply. Accordingly, the increased driver circuit complexity of the SSL unit is justified by both increased compatibility with the dimmer 400 and improved efficiency.

The power reception mode may start, for example, in a half-cycle following the half-cycle during which the dimmer setting is determined (in the readout mode). Alternatively, as discussed above, the power reception mode may start during the readout mode, as soon as the required dim information has been retrieved, regardless of completion of the half-cycle. The power reception mode may also start during the readout mode after monitoring (e.g. timeout) indicates that the present cycle is not suitable for detection of the dimmer setting, e.g., because the dimmer setting is in the process of being changed or there is some sever distortion on the mains voltage.

Accordingly, the SSL unit according to various embodiments is not forced to cope with the waveform provided by the dimmer 400, but is able to play a more active role by reading the dim information from the dimmer received via the power signal, and manipulating the power signal based on the read dim information. In addition to improving dimming characteristics of the SSL unit, the active power signal manipulation in the power reception mode provides other advantages. For example, if the SSL unit is older or otherwise deteriorating in some capacity, the input power to the SSL unit may be increased to deliver the desired level of light output, with or without dimming. Also, if the SSL unit is equipped with a sensor, such as a motion sensor, a smoke detector or the like, the input power to the SSL unit can be increased in order to brighten the output light in response to a sensor detection signal, even when the dimming level is otherwise set to a low setting. A certain dimmer setting may even lead to a standby mode, in which the SSL unit reduces input power consumption as far as possible, while remaining powered on, e.g., in order to receive remote control signals or to operate a corresponding sensor. Despite the fixed dimmer setting, the SSL unit is able to alter the input power and light output level.

The examples discussed above are to some extent limited by the presence and type of other loads that are connected to the same dimmer. For example, it may be impractical (based on size and component cost) to design an 8 W LED lamp such that it can alter the phase angle of the dimmer 400 significantly in a circuit including four 60 W incandescent light bulbs connected in parallel. To gain information on the component values inside the dimmer, multiple scenarios are possible. For example the dimmer may be analyzed beforehand, and grouped into one or more of typical predetermined categories. For each category, suitable parameter sets are derived and preprogrammed into the SSL units, which may then be labeled accordingly. Also, some fine-tuning may be performed during operation of the SSL unit. Alternative to the preprogramming (or in addition to the preprogramming), the user may be asked (e.g., via instructions in a user's manual, on a package and/or on the SSL unit itself) to set the dimmer to multiple positions, including at least minimum and maximum settings and in some configurations also a middle setting, after installation of the SSL unit. During this "initialization" process, the SSL unit is able to measure the dimmer at different known dimmer settings (e.g., settings of set resistor 420) and to extract some characterization parameters. The measurements are stored by the SSL unit for future access. Even during normal operation, new data, such as lower minimum settings, may be detected by the SSL unit.

Various examples are discussed below to further understand various embodiments. It is understood that the examples are only for purposes of illustration and explanation, and are not intended to any way limit the scope of the present teachings.

Figure 5:
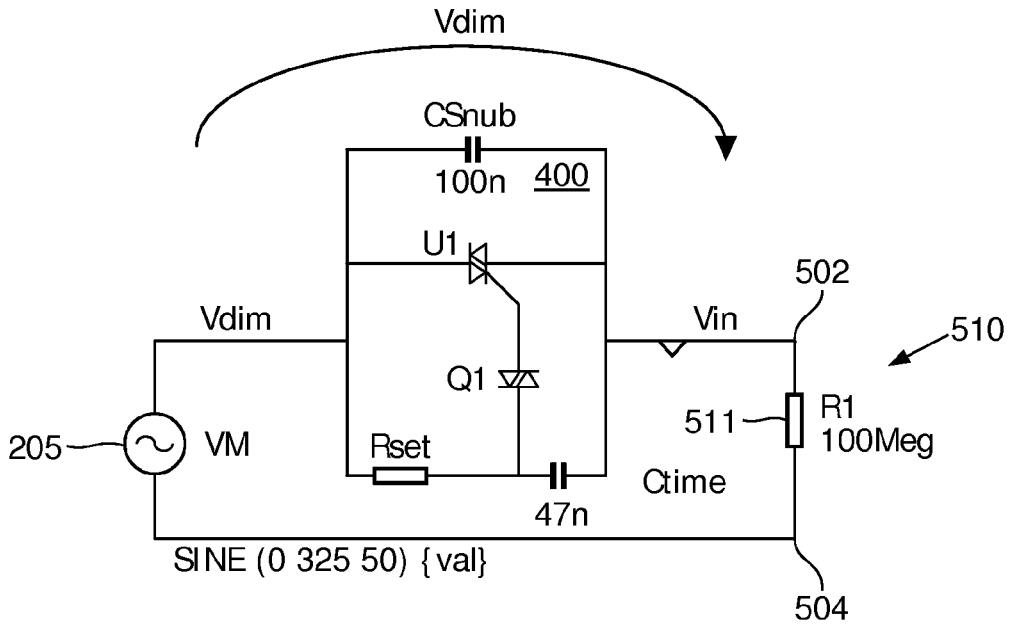
FIG. 5 is a simplified circuit diagram showing a solid state lighting system including a dimmer and an electrical representation of a solid state lighting unit in a certain mode, according to a representative embodiment.
Figure 6:
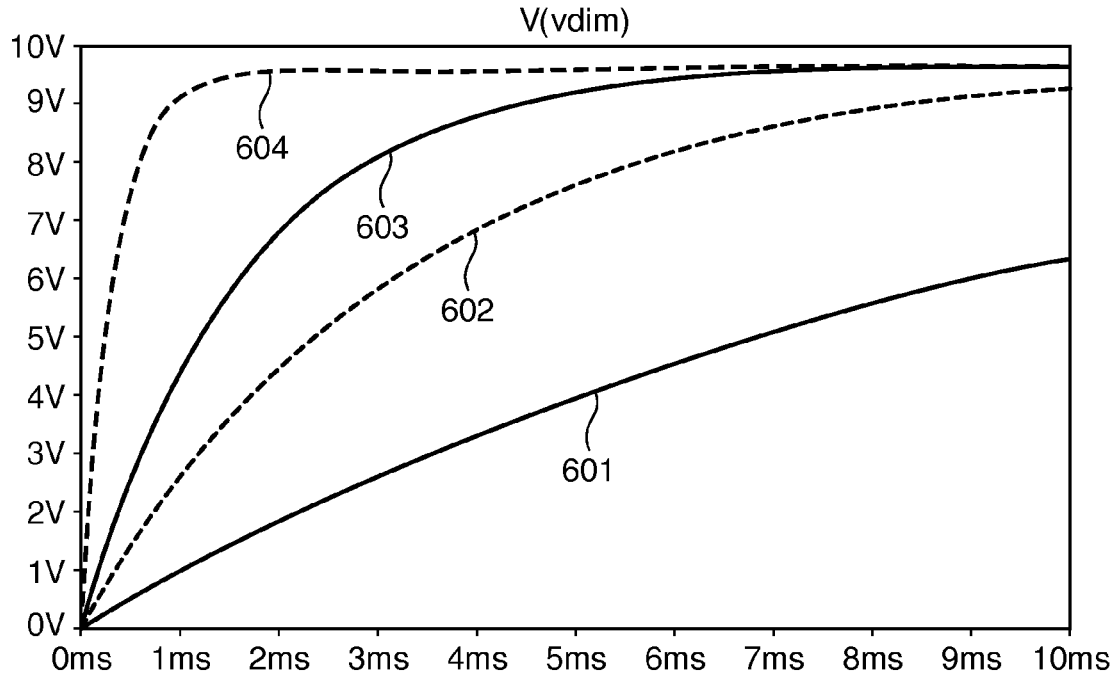
FIG. 6 is a graph showing curves of dimmer voltage waveforms corresponding to different set resistor settings, according to a representative embodiment.
Figure 7:
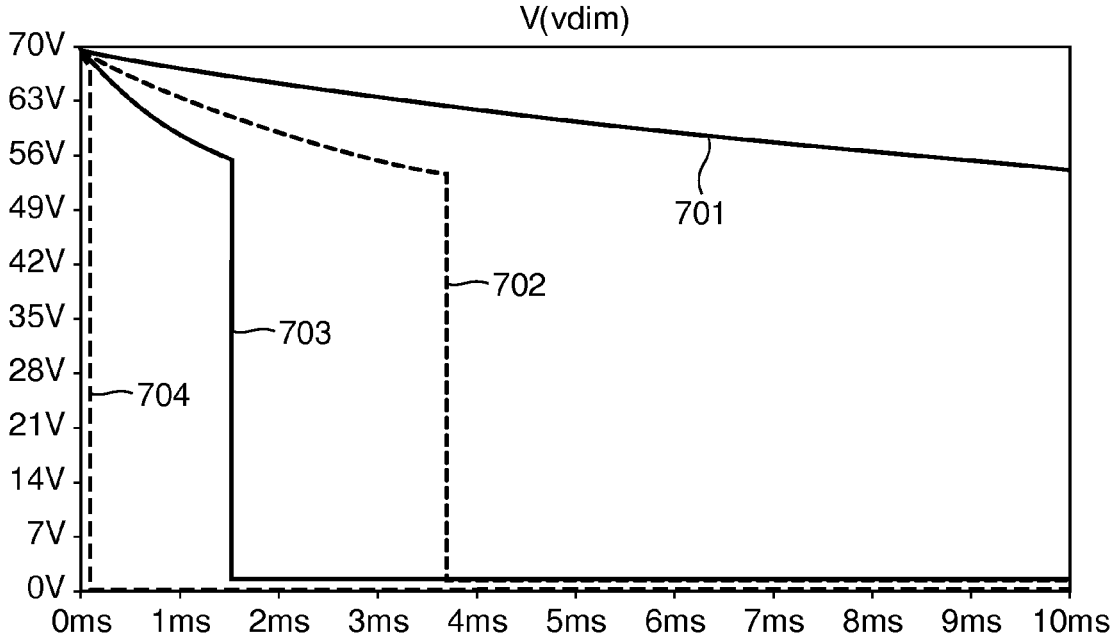
FIG. 7 is a graph showing curves of dimmer voltage waveforms corresponding to different set resistor settings, according to a representative embodiment.

A first example is shown in FIGS. 5 and 6. FIG. 5 is a simplified circuit diagram of an SSL system, including a dimmer and an SSL unit, according to a representative embodiment. FIG. 6 is a graph showing curves of illustrative waveforms of the dimmer voltage Vdim for four different settings of the set resistor of the SSL unit shown in FIG. 5, according to a representative embodiment.

In the first example, SSL system 500 includes mains voltage source 205, representative dimmer 400 (discussed above), and SSL unit 510, indicated by representative 100 MΩ resistor 511 connected between input 502 and output 504. The SSL unit 510 may be substantially the same as SSL unit 210 or 310, as discussed above with reference to FIGS. 2 and 3. The dimmer 400 includes TRIAC 411 (first switch), first capacitor 421 and a timing circuit including second capacitor 422, set resistor 420 and threshold device DIAC 412 (second switch). The slope of the dimmer voltage Vdim across the dimmer 400 is captured during the readout mode by the SSL unit 510. From previous mains cycles, the characteristics of the mains voltage Vm output by the mains voltage source 540, such as peak value, frequency, RMS value, dominant distortion, etc., are known. For example, the characteristics may be captured during a power reception mode, where dropout voltage across the TRIAC 411 of the dimmer 400 is known to be low. In the readout mode, the SSL unit 510 stays in a high impedance mode during one half cycle and monitors the input voltage Vin across the input terminals of input 502. The input voltage Vin will be the superposition of the mains voltage Vm and the dimmer voltage Vdim across the dimmer 400. The dimmer voltage Vdim is different for different dimmer settings (set points), implemented by settings of the set resistor 420 (i.e., the potentiometer).

Referring to FIG. 6, curves 601-604 are shown, which are based on the following starting conditions: the first capacitor 421 has a capacitance Csnub and has been discharged to Vsnub≈0 before the SSL unit 510 enters the readout mode, e.g., by conducting the TRIAC 411 (power switch) of the dimmer 400. The second capacitor 422 has a capacitance of Ctime and has been charged to Vtime≈25V. The curves 601-604 show the dimmer voltage Vdim responsive to four different resistance values Rset of the set resistor 420, respectively. In the depicted example, the resistance values Rset are about 300kΩ for curve 601, about 100kΩ for curve 602, about 50kΩ for curve 603 and about 30kΩ for curve 604. Based on the slope of the dimmer voltage Vdim indicated by the curves 601-604, the resistance value Rset of the adjustable set resistor 420 can be determined by the SSL unit 510 during the readout mode. The time constant $\tau$ for this transient will be $\tau$=Rset*(Csnub*Ctime/(Csnub+Ctime)). The time constant $\tau$ may be estimated, for example, using estimated stating conditions (e.g., Csnub=0, etc.) and plotting measurements of the dimmer voltage Vdim over time. Then, with knowledge of the capacitor values Csnub and Ctime, Rset may be calculated.

For other starting conditions, the dimmer voltage Vdim will have different shapes. However, as long as the capacitor voltages Vsnub and Vtime are different at the beginning of the readout mode, there will be a similar transition phase. The SSL unit 510 calculates the dimmer voltage Vdim and derives the resistance value Rset of the set resistor 420 using the known (or estimated) mains voltage Vm and the measured input voltage Vin of the SSL unit 510. As stated above, some parameters of the dimmer 400 are required, which may be previously stored in the SSL unit 510, e.g., at the factory and/or derived (and stored) during previous operations. The example shown in FIG. 6 is only valid as long as the voltage Vtime of the second capacitor 422 does not reach a trigger voltage (e.g., firing angle), at which some of the energy from the second capacitor 422 is extracted to fire the TRIAC 411.

Once the SSL unit 510 determines the value Rset of the set resistor 420 (and thus the dimmer setting), it is able to determine the desired level of output light, as discussed above. For example, the SSL unit 510 may include a look-up table that correlates dimmer settings for that particular type of dimmer 400 with output light levels. Since there are different types of potentiometer, where the resistance may vary linearly or non-linearly over travel, the preferred setting is at the middle position during initialization (as described above). Once the desired output light level is determined, the SSL unit 510 may internally generate a signal (e.g., voltage signal, current signal or impedance) that is applied to the input 502 in order to adjust the input voltage Vin to a level that will result in the desired output light level. The determination of the desired level of output light based on the value Rset may be made by a processing circuit, as discussed above, implemented as a controller or microcontroller, for example, which may include a processor or CPU, ASICs, FPGAs, or combinations thereof, using software, firmware, hard-wired analog or logic circuits, or combinations thereof.

A second example is discussed with reference to FIGS. 5 and 7. FIG. 7 is a graph showing curves of illustrative waveforms of the dimmer voltage Vdim for four different settings of the set resistor of the dimmer 400 shown in FIG. 5, according to another representative embodiment.

The second example addresses the case in which the voltage Vtime of the second capacitor 422 reaches the trigger voltage, causing the TRIAC 411 to fire. That is, the TRIAC 411 is activated, which short circuits the dimmer voltage Vdim and causes a step in the dimmer voltage Vdim, indicated in each of curves 702-704 by a vertical drop in voltage, which is reflected in the input voltage Vin of the SSL unit 510. Notably, in the depicted example, curve 701 does not include a step because the value Rset of the set resistor 420 is set to such a high value, that triggering does not occur within one time scale of FIG. 7. In an embodiment, the trigger voltage may be determined by the DIAC 412 in the dimmer 400, for example. As stated above, when starting from a well defined initial condition (before entering the readout mode, or as an initial phase of the readout mode), the time before the TRIAC 411 is triggered includes dim information on the dimmer setting of the dimmer 400. Although the trigger voltage distorts the transition phase, the dimmer setting can still be extracted.

The curves 701-704 FIG. 7 are based on the following starting conditions: the first capacitor 421 has been charged to Vsnub=100V, and the second capacitor 422 has been charged to Vtime=−5V. The curves 701-704 show the dimmer voltage Vdim responsive to four different resistance values Rset of the set resistor 420, respectively. In the depicted example, the resistance values Rset are about 300kΩ for curve 701, about 100kΩ for curve 702, 50kΩ about for curve 703 and about 30kΩ for curve 704. Depending on tolerances of the DIAC, for example, the firing of the TRIAC 410 occurs when the capacitor voltage Vtime is approximately 27V to approximately 30V. In the second example, curve 702 indicates firing in about 3.8 ms, curve 703 indicates firing in about 1.6 ms and curve 704 indicates firing in a about 0.1 ms. In other words, the lower the resistance of the set resistor 420 (i.e., less dimming or low firing angle), the sooner the TRIAC 410 fires. Both the slope of the curves 701-704 and the time to triggering (i.e., when dimmer voltage Vdim is shunted to zero) can be evaluated by the SSL unit 510 to determine the resistance value Rset of the set resistor 420 during the readout mode.

Once the SSL unit 510 determines the value Rset of the set resistor 420 (and thus the dimmer setting), it is able to determine the desired level of output light, as discussed above. Once the desired output light level is determined, the SSL unit 510 internally generates a signal (e.g., voltage signal, current signal or impedance) that is applied to input terminals of the input 502 in order to adjust the input voltage Vin to a level that will result in the desired output light level.

Figure 8:
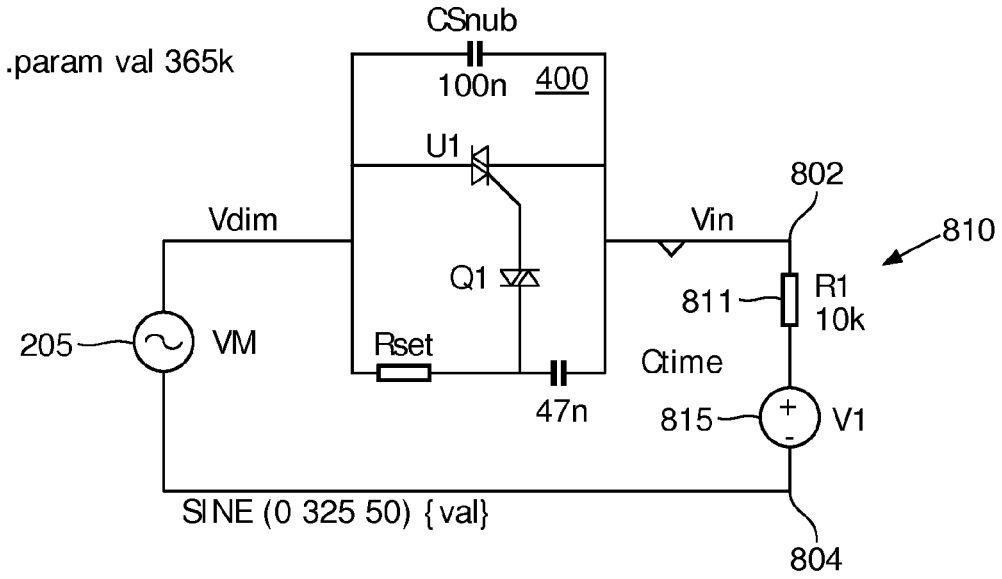
FIG. 8 is a simplified circuit diagram showing a solid state lighting system including a dimmer and an electrical representation of a solid state lighting unit in a certain mode, according to a representative embodiment.
Figure 9:
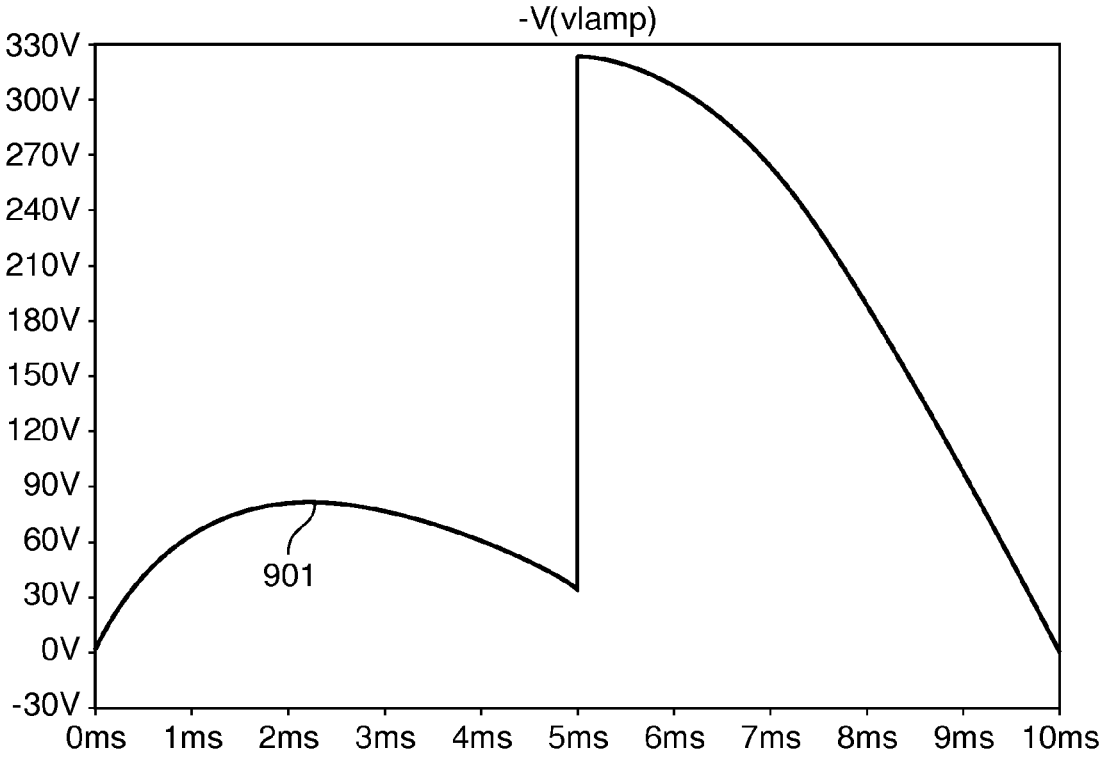
FIG. 9 is a graph showing a curve of a solid state lighting unit voltage corresponding to dimmer voltages from a dimmer in a conventional lighting unit.

A third example is discussed with reference to FIGS. 8-11B. FIG. 8 is a simplified circuit diagram of an SSL system, including a dimmer and an SSL unit, according to a representative embodiment. FIG. 9 is a graph showing a curve of an illustrative waveform of the input voltage Vin at a conventional lighting unit. FIGS. 10A, 10B and FIGS. 11A, 11B are graphs showing curves of illustrative waveforms of the input voltage Vin at an SSL unit shown in FIG. 8, according to representative embodiments.

In the third example, SSL system 800 includes mains voltage source 205, representative dimmer 400 (discussed above), and SSL unit 810, indicated by representative 10kΩ resistor 811 connected between input 802 and output 804. The SSL unit 810 may be substantially the same as SSL unit 210 or 310, as discussed above with reference to FIGS. 2 and 3. The dimmer 400 includes TRIAC 411, the first capacitor 421 and a timing circuit including the second capacitor 422, the set resistor 420 and DIAC 412, as discussed above with reference to FIG. 4. In the third example, the SSL unit 810 manipulates the capability of the dimmer 400 in the power reception mode in order to alter the input voltage Vin to manipulate the input voltage Vin. For example, the SSL unit 810 may alter the firing angle of the TRIAC 411, as discussed below, in order to manipulate the dimmer voltage Vdim, and thus the input voltage Vin.

In steady state operation, the SSL unit 810 may be operated with a peak input voltage Vpeak as follows, where ϕ is the firing angle of the TRIAC 411 in the dimmer 400, where VmPeak is the peak voltage of the voltage mains 205:

$$\phi \geq 90°: Vpeak = VmPeak * \sin(\phi)$$

$$\phi < 90°: Vpeak = VmPeak$$

In both cases, the dropout voltage (e.g., ~2V) across the TRIAC 411 of the dimmer 400 is subtracted, although this difference is ignored here for simplicity, as well as distortion of the shape of the mains voltage Vm.

For purposes of comparison, FIG. 9 provides curve 901 of an illustrative waveform of the input voltage Vin at a conventional lighting unit to show behavior of a "normal load," such as an incandescent lamp or a passive SSL lamp with a bleeder (e.g., 10kΩ in the depicted simulation). When the firing angle ϕ of the TRIAC 410 is set to 90°, the peak voltage of the so-called normal load is approximately 325V, when operated from the mains voltage source 205 having a mains voltage Vm of about 230V AC.

It may be assumed for purposes of discussion that this peak voltage is higher than the optimal peak voltage for the SSL unit 810 in order to produce the amount of light related to the corresponding dimmer setting, which would be about 50 percent maximum, while the peak voltage is just as high as with a firing angle of 0°. Since the SSL unit 810 includes a buffer capacitor (not shown), the voltage of the buffer capacitor may be used to influence the timing circuit (e.g., resistor 420 and capacitor 422) during the power reception mode. The SSL unit 810 seeks a lower peak voltage, hence the firing angle of the dimmer 400 must be delayed in order to achieve the lower peak voltage. In order to delay the firing, charging of the timing circuit likewise must be delayed. The SSL unit 810 produces a positive input voltage Vin (e.g., a positive mains half cycle) at input terminals of input 802, in order to reduce the effective dimmer voltage Vdim across the dimmer 400. More particularly, the SSL unit 810 provides a voltage with the same polarity as the actual sign of the mains voltage Vm. Reducing the effective dimmer voltage Vdim delays the charging of the capacitor 422 in the timing circuit and firing of the TRIAC 410 in the dimmer 400.

Figure 10A:
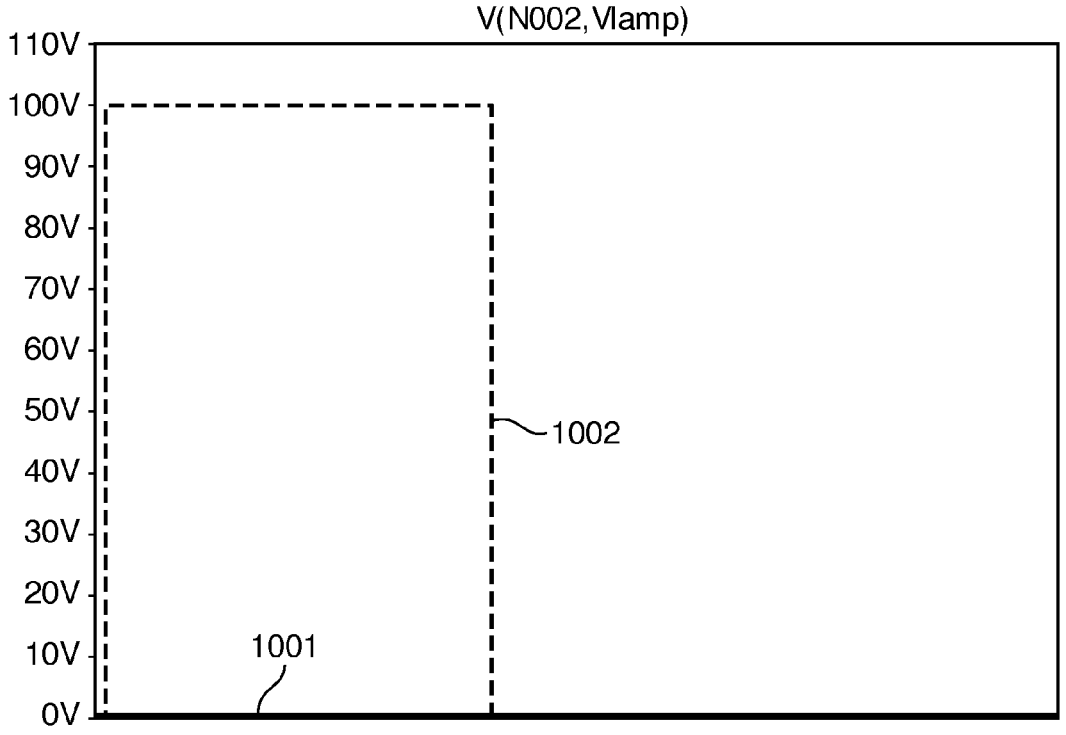
FIGS. 10A and 10B are graphs showing curves of solid state lighting unit voltages corresponding to dimmer voltages from a dimmer in conventional and solid state lighting units, according to a representative embodiment.
Figure 10B:
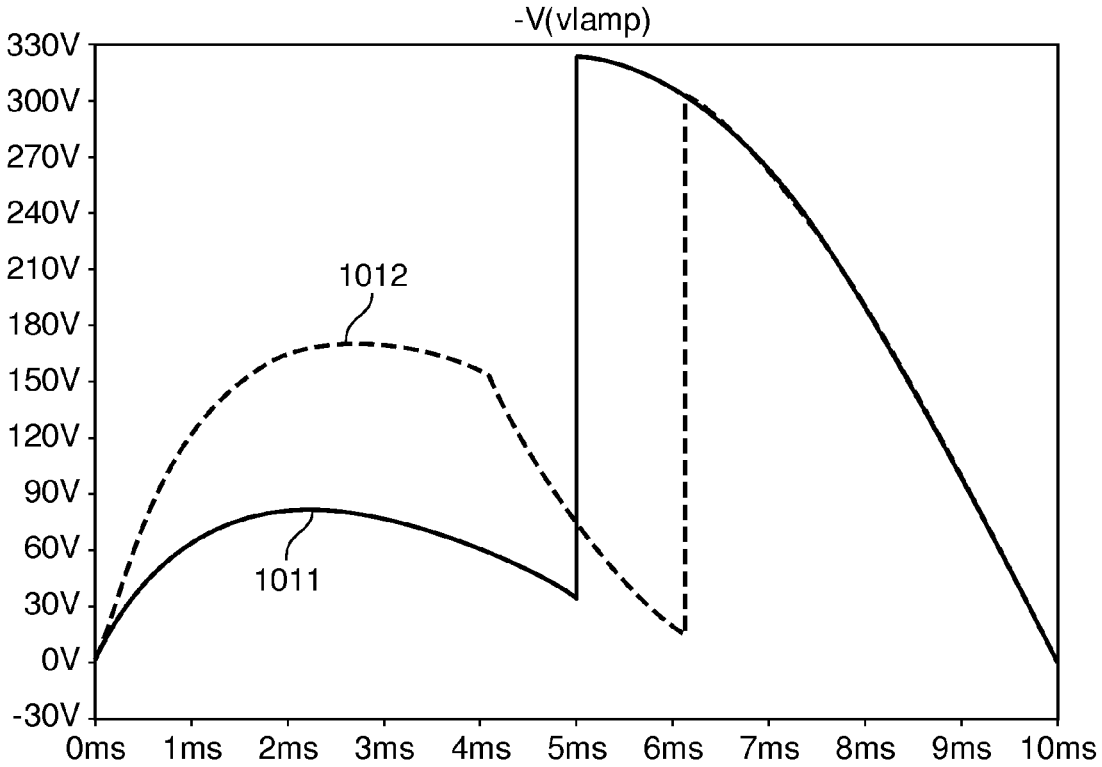

However, according to various embodiments, the SSL unit 810 has available multiple internal voltage levels, e.g., from taps of an LED string or other sources. In the simulation depicted in FIGS. 10A and 10B, showing curves of illustrative waveforms of the input voltage Vin at an SSL unit 810, a voltage of 100V from representative voltage source 815 is applied to the input 802 of the SSL unit 810 for a time period of about 4 ms. As discussed above, other types of signal generators may be incorporated without departing from the scope of the present teachings. In particular, FIG. 10A provides curves 1001 and 1002, which show voltage V1 of the voltage source 815, and FIG. 10B provides curves 1011 and 1012, which show illustrative peak voltage waveforms of the input voltage Vin at a conventional lighting unit and the SSL unit 810, respectively.

In the simulation, the voltage source 815 is in series with the 10kΩ impedance of resistor 811, which may be a bleeder, for example, and provides voltage V1. In a practical implementation, the voltage source 815 is used instead of impedance or a high impedance mode. Referring to FIG. 10A, curve 1002 shows application of a positive voltage V1 at about 100V (assuming positive mains voltage Vm) at the input 802 of the SSL unit 810 for a period of about 4.2 ms. The applied voltage V1, in combination with the mains voltage Vm and the impedance (resistor 811) of the SSL unit 810, reduces the dimmer voltage Vdim across the dimmer 400, and therefore delays the charging of the timing circuit, which in turn delays the firing action of the TRIAC 410. Referring to FIG. 10B, curve 1012 shows the firing of the TIRAC 411 occurring at about 6.1 ms, resulting in a peak voltage of the SSL unit 810 of only about 300V. In comparison, curve 1011, which depicts operation of a normal load in which no voltage V1 is applied (indicated by curve 1001), shows the firing of the TIRAC 411 occurring earlier, at about 5.0 ms, resulting in a higher peak voltage of about 330V.

Figure 11A:
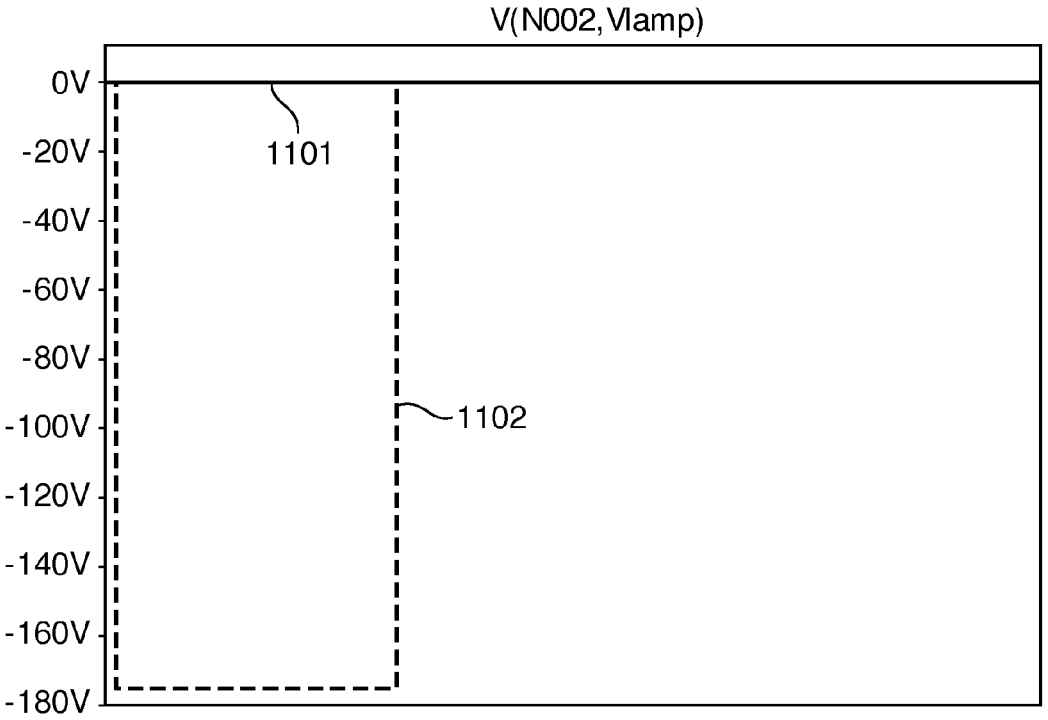
FIGS. 11A and 11B are graphs showing curves of solid state lighting unit voltages corresponding to dimmer voltages from a dimmer in conventional and solid state lighting units, according to a representative embodiment.
Figure 11B:
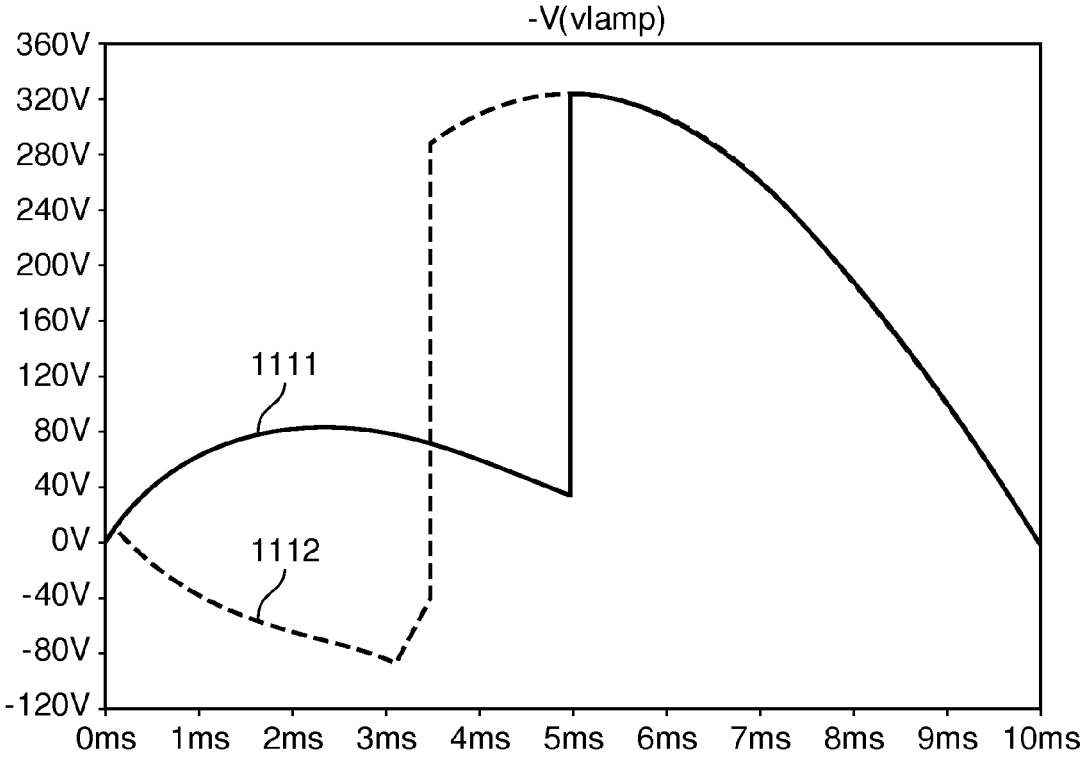

Alternatively, the SSL unit 810 may shift the firing of the TRIAC 410 towards earlier points in time, as shown in the representative embodiment depicted in FIGS. 11A and 11B. Assuming continuous current flow that maintains the TRIAC 411 in a conduction mode, shifting the firing of the TRIAC 411 earlier does not change the peak voltage in this example (since both curves include the same peak at 5 ms), but can still provide an advantageous condition. For example, earlier firing helps to smoothly recharge current pulse into the buffer capacitor of the power reception unit or LED driver, such capacitors 1272 and 1372 in FIGS. 12 and 13, below. The buffer capacitor will discharge, at least during the off period of the TRIAC 411, because energy must be delivered to the LEDs in order to provide continuous light output. Typically, after discharge, the voltage in the buffer capacitor will be lower than the previously charged peak value. When the TRIAC 411 is fired at 90°, for example, this can cause a high charging current peak, which stresses the components and reduces the maximum number of lamps (e.g., including SSL unit 810) connectable to the dimmer 400. When the SSL unit 810 changes the firing angle to value lower than 90° (i.e., earlier firing), a lower input voltage Vin is presented to the SSL unit 810 at the time of firing. When the input voltage Vin is close to the voltage Vtime of the (discharged) buffer capacitor, there will be a smooth charging current flowing.

The manipulation during power reception mode is depicted in FIGS. 11A and 11B. In particular, FIG. 11A provides curves 1101 and 1102, which show voltage V1 of the voltage source 815, and FIG. 11B provides curves 1111 and 1112, which show illustrative peak voltage waveforms of the input voltage Vin at a conventional lighting unit and the SSL unit 810, respectively. Referring to FIG. 10A, curve 1102 shows application of a negative voltage V1 at about −175V (again assuming positive mains voltage Vm) at the input 802 of the SSL unit 810 for a period of about 3.0 ms. This increases the dimmer voltage Vdim across the dimmer 400, speeding up the charging of the timer circuit and resulting in early firing of the TRIAC 410. That is, referring to FIG. 11B, curve 1112 shows the firing of the TIRAC 410 occurring at about 3.5 ms, resulting in an instantaneous voltage to the SSL unit 810 of about 288V. This is lower than the following peak voltage of the voltage mains Vm. In comparison, curve 1111, which depicts operation of a normal load in which no voltage V1 is applied (indicated by curve 1101), shows the firing of the TIRAC 410 occurring later, at about 5.0 ms, resulting in a higher instantaneous peak voltage of about 330V.

As mentioned above, changing the firing angle of the TRIAC 400, e.g., by application of the voltage V1 in the SSL unit 810, may change the value of the mains voltage Vm during firing to increase efficiency and/or to reduce components stress. Further, changing the firing angle may influence the voltage*time area of the input voltage Vin, avoid certain firing angles that have been detected to be unstable, influence the harmonic spectrum of an input current, and suppress audible noise. Also, application of the voltage V1 may also be used to achieve suitable starting condition for the readout mode.

There are multiple ways to realize a high impedance input mode (e.g. when an SSL unit is not actively reading, but listening to the signals generated by other lighting units). First, the SSL unit may include a serial switch. Second, the buffer capacitor in the SSL unit can be charged to a voltage higher than any peak of the input signal Vin, because then the bridge rectifier will isolate the input from any load in the SSL unit. High impedance voltage sensing means (e.g., a resistive voltage divider) may be arranged parallel to the power input stage present at the input terminals of the SSL unit.

Of course, in addition to controlling the input power at its input terminals, the SSL unit should deliver energy to the load (e.g., LED module), as well, in order to produce output light according to the desired dim level. The delivery of power will result in continuous light output of the SSL unit, such that the sequence and performance of the readout mode and the power reception mode does not interfere with the output light production. Switch mode power supply circuits or linear driver can be used for this, as would be apparent to one of ordinary skill in the art.

Also, application of the input voltage Vin to the input terminals of the SSL unit should be timed so that it ends before the power switch (e.g., the TRIAC 411) of the dimmer switches on (closes, fires). This enables the SSL unit to safely terminate the process of delivering voltage and to return to a "passive" mode, in which it receives voltages and currents. However, the components of the SSL unit involved in actively providing voltage should be rated or otherwise protected, such that dimmer switching during voltage application does not impact reliability of the SSL unit.

As mentioned above, the SSL unit may further include energy storage (e.g., one or more capacitors, typically referred to as buffer capacitor) to provide energy to the SSL load (e.g., LEDs) during the readout mode, and also during the power reception mode, e.g., around the zero crossing, the input voltage and power may be not sufficient to power the LED to the desired light output level. In an embodiment, the readout mode may finish in less than a half cycle of the mains voltage Vm, as discussed above. In this case, the SSL unit may return to power reception mode immediately, which reduces the required amount of energy storage, reducing the size and cost of the component.

Figure 12:
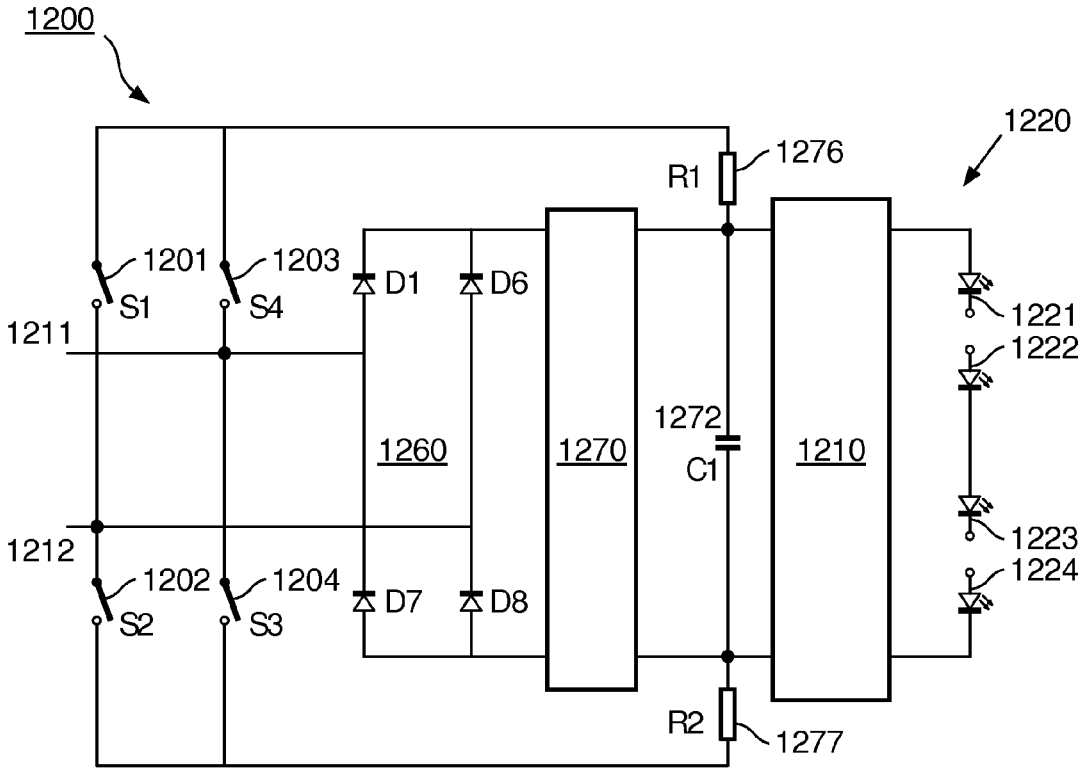
FIG. 12 is a simplified circuit diagram showing a solid state lighting unit, according to a representative embodiment.

FIG. 12 is a simplified circuit diagram showing a solid state lighting unit, according to a representative embodiment.

Referring to FIG. 12, SSL unit 1200 has an input stage (e.g., for receiving power signal from a dimmer) that includes switches 1201-1204, bridge rectifier 1260, and a power converter 1270. The SSL unit 1200 also includes LED driver 1210 and LED module 1220 with representative LEDs 1221-1224. The LED driver 1210 provides drive current to the LEDs 1221-1224. Capacitor 1272 is on the DC-side of the power converter 1270. Normally, without the switches 1201-1205, the capacitor voltage of the capacitor 1272 cannot be given actively to the input on the AC side of the power converter 1270. Of course, during charging, the capacitor voltage on the DC side will determine the input voltage level at which charging begins. To this end, the capacitor voltage of the capacitor 1272 is visible at the input terminals 1211 and 1212 of the SSL unit 1210, although this is not sufficient for the disclosed mode of operation.

For full flexibility, the SSL unit 1200 is capable of producing an input voltage Vin freely selectable over a certain range, e.g. about −400V to about +400V. In the simple example depicted in FIG. 12, only the positive or negative capacitor voltage of the capacitor 1272 may be applied to the input terminals 1211 and 1212 of the SSL unit 1200. In addition to the bridge rectifier 1260 and the capacitor 1272, as well as current shaping means (e.g., resistors or PFC circuit), the simple switches 1201-1204 enable the presentation of the capacitor voltage with selectable polarity at the input terminals 1211 and 1212. Resistors 1276 and 1277 represent protection means, arranged at the depicted positions, for example.

Other topologies, including more or fewer switches with different decoupling and protection means and/or different access points, e.g., towards the LED module 1220, may be provided, without departing from the scope of the present teachings.

Figure 13:
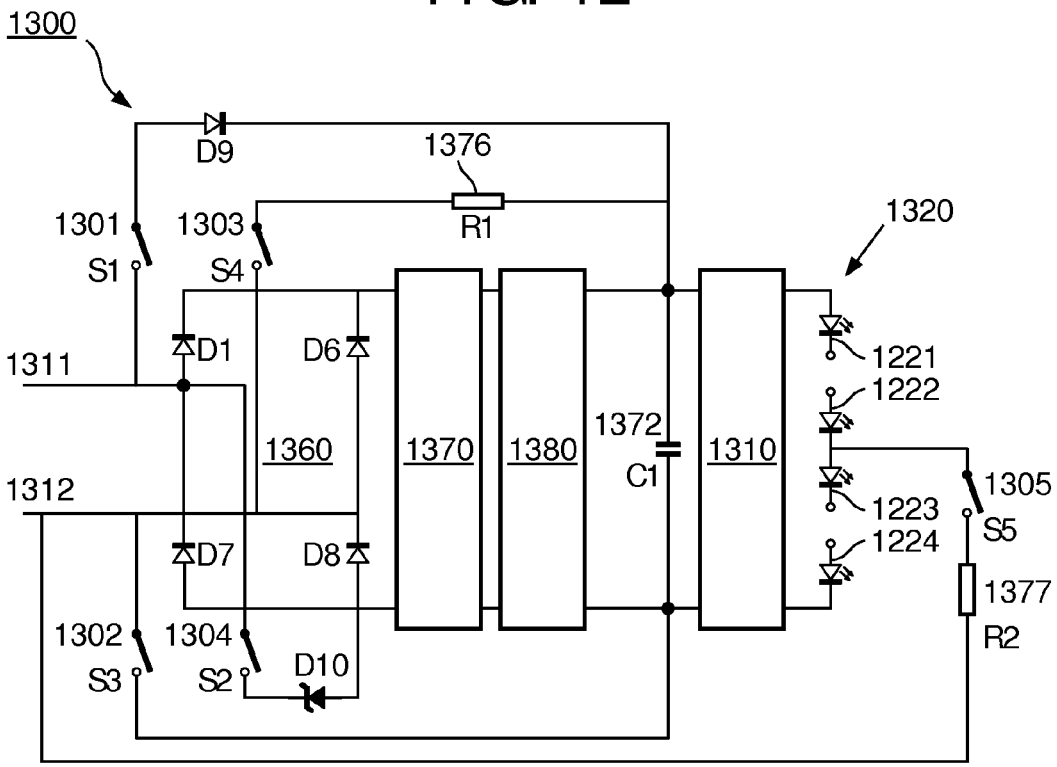
FIG. 13 is a simplified circuit diagram showing a solid state lighting unit, according to a representative embodiment.

FIG. 13 is a simplified circuit diagram showing a solid state lighting unit, according to a representative embodiment.

Referring to FIG. 13, solid state lighting unit 1300 has an input stage (e.g., for receiving power signal from a dimmer) that includes switches 1301-1304, bridge rectifier 1360, a power converter 1370 and a current shaper 1380. The current shaper 1380 may include resistors and/or a PFC circuit, for example. The SSL unit 1300 also includes LED driver 1310 and LED module 1320 with representative LEDs 1321-1324. The LED driver 1310 provides drive current to the LEDs 1321-1324. Capacitor 1372 is on the DC-side of the power converter 1370. The capacitor voltage of the capacitor 1372 is visible at the input terminals 1311 and 1312 of the SSL unit 1300. Resistors 1376 and 1377 represent protection means, arranged at the depicted positions, for example. The SSL unit 1300 further includes switch 1305, which is used to apply a certain voltage level, available within the LED module 1320, to the input terminals 1311 and 1312.

The SSL units according to the various embodiments discussed herein may be applied to retrofit applications, where it is desired to control the light output based on the mains voltage signal. For example, the SSL unit may be used for applications in which the LED bulbs are replacing traditional magnetic ballasts.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims in parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A method of determining an amount of light to be output from a solid state lighting (SSL) unit, comprising an SSL load, based on a dimmer setting of a dimmer connected to input terminals of the SSL unit, the method comprising:

determining the dimmer setting of the dimmer during a readout mode by analyzing a power signal received from the dimmer at the input terminals of the SSL unit;

determining a desired level of light to be output from the SSL unit corresponding to the determined dimmer setting;

determining power needed at the input terminals of the SSL unit for the SSL load to output the desired level of output light;

determining a value of an adjusting signal for adjusting the power at the input terminals of the SSL unit, based at least in part on the determined dimmer setting; and adjusting the power at the input terminals of the SSL unit during a power reception mode using the determined value of the adjusting signal, thereby powering the SSL unit to output the desired level of light.

2. The method of claim 1, wherein the power signal comprises a phase cut power signal.

3. The method of claim 1, further comprising:

generating the drive current for driving the SSL load of the SSL unit in response to the adjusting signal.

4. The method of claim 3, further comprising:

receiving feedback indicating an actual setpoint of the SSL load;

comparing the actual setpoint with a desired setpoint corresponding to the desired level of light; and adjusting a setpoint command in response to the comparison.

5. The method of claim 1, wherein determining the dimmer setting during the readout mode comprises:

monitoring the input voltage signal, the input voltage being a superposition of a mains voltage and a dimmer voltage across the dimmer; and determining a setting of the dimmer, based on the dimmer voltage portion in the input voltage signal, the setting determining the phase angle of the dimmer setting.

6. The method of claim 5, wherein determining the setting of the dimmer comprises:

bringing the dimmer into a non-conducting state with known initial conditions; and measuring a slope of the dimmer voltage based on at least one of the input voltage signal and an estimation of the mains voltage.

7. The method of claim 5, wherein determining the setting of the dimmer comprises:

measuring a time until firing of a dimmer switch in the dimmer based on at least one of the input voltage signal and an estimation of the mains voltage; and deriving the setting of the dimmer from the measured time.

8. The method of claim 5, where the setting of the dimmer comprises a potentiometer setting.

9. The method of claim 1, wherein the adjusting signal comprises one of a voltage signal, a current signal or an impedance for adjusting an input voltage at the input terminals of the SSL unit.

10. The method of claim 9, wherein adjusting the input voltage at the input terminals of the SSL unit comprises:

adjusting the dimmer voltage output by the dimmer.

11. The method of claim 10, wherein the dimmer comprises a phase-cut dimmer and adjusting the dimmer voltage output by the dimmer comprises adjusting timing of a firing angle in the dimmer.

12. The method of claim 1, wherein the readout mode occurs during a first predetermined number of half cycles of an AC mains voltage and the power reception mode occurs during a second predetermined number of half cycles of the AC mains voltage following the first predetermined number of half cycles.

13. A method of controlling light output by a solid state lighting (SSL) unit connectable to a dimmer, the method comprising:

receiving a power signal at an input terminal of the SSL unit from the dimmer;

determining a potentiometer setting of the dimmer based on the power signal;

determining a desired level of output light from the SSL unit corresponding to the determined potentiometer setting;

determining a desired input voltage at the input terminal of the SSL unit that would cause the SSL unit to output the desired level of output light; and determining a value of an adjusting signal needed to adjust an input voltage at the input terminal to equal the determined desired input voltage.

14. The method of claim 13, wherein the adjusting signal comprises one of a voltage signal, a current signal or an impedance.

15. The method of claim 13, further comprising: adjusting the input voltage at the input terminal of the SSL unit using the adjusting signal.

16. The method of claim 15, wherein adjusting the input voltage at the input terminal of the SSL unit comprises adjusting a dimmer voltage output by the dimmer.

17. A solid state lighting (SSL) unit configured to connect to a dimmer in a dimmer circuit, the SSL unit comprising:

a light emitting diode (LED) module;

at least one input terminal configured to receive input power from the dimmer, the input power corresponding to a dimmer voltage across the dimmer;

a processing circuit configured to determine a dimmer setting of the dimmer during a readout mode by analyzing the input power, the dimmer setting indicating a desired level of output light from the LED module;

a signal generating module configured to generate an adjusting signal based at least in part on the determined dimmer setting; and a power reception module configured to adjust the input power at the at least one input terminal during a power reception mode using the adjusting signal to cause the LED module to output the desired level of light.

18. The SSL unit of claim 17, wherein the signal generating module and the power reception module are connected in parallel between the at least one input terminal and at least one output terminal.

19. The SSL unit of claim 17, wherein the signal generating module and the power reception module are connected in series between the at least one input terminal and at least one output terminal.

* * * * *